United States Patent [19]

Inomata et al.

[11] 4,385,932

[45] May 31, 1983

[54] AMORPHOUS MAGNETIC ALLOY

[75] Inventors: Koichiro Inomata, Yokohama; Michio Hasegawa, Machida; Senji Shimanuki, Atsugi; Masakatsu Haga, Yokohama, all of Japan

[73] Assignee: Tokyo Shibaura Denki Kabushiki Kaisha, Kawasaki, Japan

[21] Appl. No.: 270,568

[22] Filed: Jun. 4, 1981

[30] Foreign Application Priority Data

Jun. 24, 1980 [JP] Japan ..... 55-84588

[51] Int. Cl.[3] ..... C22C 33/00

[52] U.S. Cl. ..... 75/123 B; 75/123 H; 75/123 J; 75/123 K; 75/123 L; 75/123 M; 75/123 N; 75/128 C; 75/128 F

[58] Field of Search ..... 75/123 B, 123 H, 123 N, 75/123 J, 123 L, 123 M, 126 B, 126 C, 126 D, 126 E, 126 F, 126 P, 126 Q, 128 A, 128 C, 128 F, 128 G, 128 Z, 128 T, 128 W, 128 V, 134 F, 134 V, 134 M, 134 S, 134 P, 170, 171

[56] References Cited

U.S. PATENT DOCUMENTS

| | | | |
|---|---|---|---|
| 3,856,513 | 12/1924 | Chen | 75/122 |
| 3,940,293 | 2/1976 | Polk et al. | 75/170 |
| 4,052,201 | 10/1977 | Polk et al. | 75/134 F |
| 4,056,411 | 11/1977 | Chen et al. | 75/134 F |
| 4,188,211 | 2/1980 | Yamaguchi et al. | 75/171 |
| 4,225,339 | 9/1980 | Inomata et al. | 75/122 |
| 4,282,046 | 8/1981 | Frischmann et al. | 148/121 |

FOREIGN PATENT DOCUMENTS

| | | |
|---|---|---|
| 3001889 | 7/1980 | Fed. Rep. of Germany . |
| 51-77899 | 7/1976 | Japan . |
| 55-19976 | 5/1980 | Japan . |
| 55-161048 | 12/1980 | Japan . |

OTHER PUBLICATIONS

Japanese Journal of Applied Physics, vol. 19, No. 1, Jan. 1980, pp. 51–54, M. Goto et al., "Magnetic Properties of the Amorphous Alloy System".

Patent Abstracts of Japan, vol. 2, No. 82, Jun. 30, 1978, p. 3470 E 78, (and Japan 53 46698).

Chemical Abstracts, vol. 90, No. 26, 1979, p. 698 abstract 214226k.

Ohnuma S. et al., "Amorphous Magnetic Alloys (Iron, Cobalt, Nickel)-(Silicon, Boron) with High Permeability and its Thermal Stability," Rapidly Quenched Met., Proc. Int. Conf., 3rd. 1978, 2, 197–204, *Abstract*.

Patent Abstracts of Japan, vol. 3, No. 147, Dec. 5, 1979, p. 164c66 (Kokai No. 54–127825).

Patent Abstracts of Japan vol. 2, No. 85, Dec. 7, 1978 p. 1329c78 (Kokai No. 53-47321).

*Primary Examiner*—John P. Sheehan

*Attorney, Agent, or Firm*—Oblon, Fisher, Spivak, McClelland & Maier

[57] ABSTRACT

An amorphous magnetic alloy has a general formula:

$$(Fe_{1-a}.Ni_a)_{100-x-y}.Si_x.B_y$$

where $0.2 \leqq a \leqq 0.7$ $1 \leqq x \leqq 20$ $5 \leqq y \leqq 9.5$ $15 \leqq x+y \leqq 29.5$ The alloy is low in iron loss and suitable for forming a magnetic core used under a high frequency.

4 Claims, 1 Drawing Figure

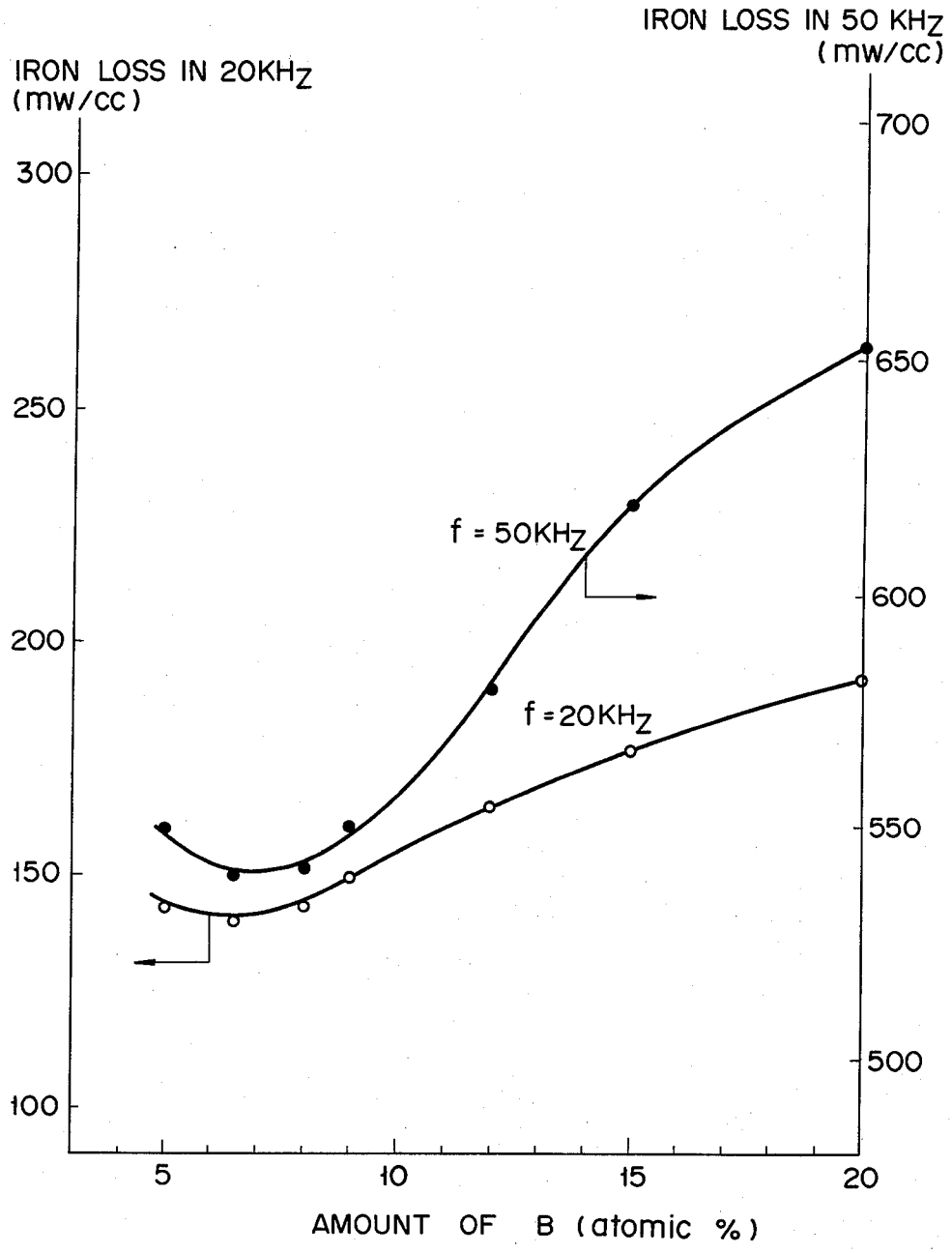
IRON LOSS IN 20KHz
(mw/cc)
IRON LOSS IN 50 KHz
(mw/cc)
300
250
200
150
100
700
650
600
550
500
f = 50KHz
f = 20KHz
5
10
15
20
AMOUNT OF B (atomic %)

AMORPHOUS MAGNETIC ALLOY

This invention relates to an amorphous magnetic alloy used for forming, for example, a magnetic core of an electromagnetic apparatus, particularly, to an amorphous magnetic alloy small in iron loss and suitable for forming a magnetic core used under a high frequency as in, for example, a switching regulator.

It was customary to use crystalline materials such as Permalloy and ferrite for forming a magnetic core used under a high frequency as in switching regulators. However, Permalloy is low in specific resistance and, thus, high in iron loss when used under a high frequency region. Certainly, ferrite is low in iron loss under a high frequency region. But, the magnetic flux density of ferrite is as low as at most 5000 G, with the result that the saturation is approached when the ferrite is used under operating conditions requiring a high magnetic flux density, leading to an increased iron loss. Also, it is desirable that the transformer used under a high frequency region, e.g., the power source transformer included in a switching regulator, would be made smaller in size. Thus, it is absolutely necessary to increase the operation magnetic flux density. It follows that the increased iron loss of ferrite is a big practical problem to be solved.

Recently, an amorphous magnetic alloy, which exhibits excellent soft magnetic properties such as a high magnetic permeability and a low coercive force, attracts attentions in this field. The amorphous magnetic alloy comprises basic metals such as Fe, Co, and Ni, and metalloids, which serve to make the alloy amorphous, such as P, C, B, Si, Al and Ge. However, the conventional amorphous alloy is not necessarily low in iron loss under a high frequency region. For example, an Fe-based amorphous alloy exhibits an iron loss as low as less than one-fourth of that of a silicon steel under a low frequency region of 50 to 60 Hz. But, the iron loss of the Fe-based amorphous alloy is markedly increased under a high frequency region of 10 to 50 kHz. To be brief, the conventional amorphous magnetic alloy is not suitable for use under a high frequency region as in a switching regulator.

An object of this invention is to provide an amorphous magnetic alloy exhibiting an iron loss small enough to put the alloy to practical use and suitable for forming a magnetic core requiring a high magnetic flux density and used under a high frequency.

According to this invention, there is provided an amorphous magnetic alloy having a general formula (A):

$$(Fe_{1-a}.Ni_a)_{100-x-y}.Si_x.B_y \qquad (A)$$

where, $0.2 \leqq a \leqq 0.7$ $1 \leqq x \leqq 20$ $5 \leqq y \leqq 9.5$ $15 \leqq x+y \leqq 29.5$ Preferably, the boron content (atomic %) of the alloy, i.e., the value of "y", should range between 6 and 8 ($6 \leqq y \leqq 8$). Also, the nickel content (atomic %) of the alloy, i.e., the value of "a", should preferably range between 0.3 and 0.45 ($0.3 \leqq a \leqq 0.45$). It is possible to replace part of Fe by at least one element selected from the group consisting of Ti, V, Cr, Mn, Co, Zr, Nb, Mo, Ta and W in an amount of 1 to 10 atomic % based on the sum of transition metals in the alloy. In the preferred embodiments mentioned above, the iron loss of the alloy is further decreased under a high frequency region.

This invention can be more fully understood from the following detailed description when taken in conjunction with the accompanying drawing, in which:

FIG. 1 is a graph of iron loss relative to the boron content (atomic %) of the amorphous magnetic alloy of this invention.

The amorphous magnetic alloy of this invention has a general formula (A):

$$(Fe_{1-a}.Ni_a)_{100-x-y}.Si_x.B_y \qquad (A)$$

where, $0.2 \leqq a \leqq 0.7$ $1 \leqq x \leqq 20$ $5 \leqq y \leqq 9.5$ $15 \leqq x+y \leqq 29.5$ Nickel serves to decrease the iron loss of the alloy under a high frequency region. But, the effect mentioned can not be produced if the Ni content is less than 20 atomic % based on the sum of Fe and Ni. On the other hand, the Ni content exceeding 70 atomic % based on the sum of Fe and Ni markedly lowers the Curie point of the alloy and decreases the magnetic flux density of the alloy to less than 5,000 G, rendering the alloy unsuitable for practical use. Preferably, the Ni content of the alloy should range between 30 atomic % and 45 atomic % based on the sum of Fe and Ni. The preferred range of Ni content mentioned permits prominently enhancing the magnetic flux density and markedly decreasing the iron loss of the alloy.

If the B content of the alloy is less than 5 atomic %, it is difficult to produce an amorphous alloy. Particularly, the alloy is rendered crystalline if the B content is less than 4 atomic %. On the other hand, the B content exceeding 9.5 atomic % fails to permit decreasing the iron loss of the alloy. Preferably, the B content should range between 6 and 8 atomic % for providing an amorphous alloy exhibiting an extremely low iron loss.

Silicon serves to make the alloy amorphous and decrease the iron loss of the alloy. But, the effect mentioned can not be produced if the Si content of the alloy is less than 1 atomic %. On the other hand, the Si content exceeding 20 atomic % fails to permit producing an amorphous alloy. Further, the sum of Si and B ranges between 15 and 29.5 atomic % in this invention. If the sum mentioned does not fall within the range mentioned, it is difficult to produce an amorphous alloy.

In this invention, it is possible to replace Fe partly by at least one element selected from the group consisting of Ti, V, Cr, Mn, Co, Zr, Nb, Mo, Ta and W. The amount of the additive element mentioned should range between 1 and 10 atomic % based on the sum of transition metals in the alloy. If the content of the additive element is less than 1 atomic %, the effect of decreasing the iron loss can not be produced. On the other hand, the content of the additive element higher than 10 atomic % renders it difficult to produce an amorphous alloy. Among the additive element mentioned above, Cr is particularly effective for decreasing the iron loss of the alloy.

The amorphous magnetic alloy of this invention is higher in magnetic flux density and lower in iron loss under, particularly, a high frequency region than ferrite. It follows that the alloy of this invention can be used for forming a transformer used under a high frequency as in a switching regulator so as to make the transformer smaller in size.

EXAMPLE 1

Various molten alloys were prepared first. Then, each of the molten alloys was ejected by argon gas pressure through a quartz nozzle into a clearance between a pair of cooling rolls rapidly rotating in opposite directions so as to rapidly cool the alloy at the rate of $10^{6}$° C./sec and obtain a band-like amorphous alloy strip 2 mm wide, 30 μm thick and 10 m long. Further, a sample 140 cm long was cut from the alloy strip and wound around an alumina bobbin 20 mm in diameter, followed by subjecting the sample to a heat treatment at 400° C. for 30 minutes. Finally, the sample was provided with primary and secondary windings each consisting of 70 turns so as to produce a magnetic core.

The iron loss of each of the magnetic cores thus produced was measured with a wattmeter. Also, the saturation magnetization of the magnetic core was measured with a sample vibration type magnetometer. Table 1 shows the results. The iron loss measured covers cases where the magnetic cores were put under frequencies of 10 kHz, 20 kHz and 50 kHz in magnetic flux density of 3 kG.

TABLE 1

| Test Piece | Composition | Magnetic Flux Density (G) | Iron Loss (mW/cc) 10 kHz | 20 kHz | 50 kHz |
|---|---|---|---|---|---|
| 1 | $(Fe_{0.6}Ni_{0.4})_{80}Si_{14}B_6$ | 11,200 | 65 | 170 | 620 |
| 2 | $(Fe_{0.7}Ni_{0.3})_{80}Si_{14}B_6$ | 13,000 | 80 | 190 | 640 |
| 3 | $(Fe_{0.5}Ni_{0.5})_{80}Si_{14}B_6$ | 9,200 | 50 | 150 | 550 |
| 4 | $(Fe_{0.4}Ni_{0.6})_{80}Si_{14}B_6$ | 6,400 | 45 | 140 | 510 |

EXAMPLE 2

Magnetic cores were produced and the iron loss and saturation magnetization thereof were measured as in Example 1, except that Fe contained in the amorphous magnetic alloy was partly replaced by the additive metal element M. Table 2 shows the results together with control cases.

TABLE 2

| Test Piece | Composition | Magnetic Flux Density (G) | Iron Loss (mW/cc) 10 kHz | 20 kHz | 50 kHz |
|---|---|---|---|---|---|
| | $[(Fe_{0.775}Ni_{0.2}M_{0.025})_{80}Si_{11}B_9]$ | | | | |
| 5 | M = Ti | 13,500 | 65 | 160 | 550 |
| 6 | V | 13,500 | 65 | 160 | |
| 7 | Cr | 13,400 | 55 | 130 | 450 |
| 8 | Mn | 13,400 | 55 | 155 | |
| 9 | Co | 13,800 | 45 | 140 | 510 |
| 10 | Zr | 13,500 | 55 | 155 | |
| 11 | Nb | 13,500 | 50 | 150 | 500 |
| 12 | Mo | 13,600 | 50 | 150 | |
| 13 | Ta | 13,600 | 50 | 150 | |
| 14 | W | 13,600 | 50 | 150 | |
| | $[(Fe_{0.58}Ni_{0.4}M_{0.02})_{82}Si_{13}B_5]$ | | | | |
| 15 | M = Ti | 8,400 | 70 | 170 | |
| 16 | V | 8,400 | 70 | 170 | |
| 17 | Cr | 8,300 | 68 | 155 | 500 |
| 18 | Mn | 8,600 | 68 | 168 | 540 |
| 19 | Nb | 8,300 | 65 | 165 | |
| 20 | Ta | 8,300 | 67 | 165 | |
| | $[(Fe_{0.58}Ni_{0.4}M_{0.02})_{82}Si_{11}B_7]$ | | | | |
| 21 | M = Ti | 8,700 | 60 | 150 | |
| 22 | V | 8,700 | 60 | 140 | 510 |
| 23 | Cr | 8,500 | 56 | 150 | |
| 24 | Mn | 8,900 | 57 | 150 | |
| 25 | Nb | 8,500 | 55 | 145 | |
| 26 | Mo | 8,500 | 55 | 145 | 500 |
| 27 | W | 8,500 | 55 | 150 | |
| Control 1 | $(Fe_{0.8}Ni_{0.2})_{78}Si_8B_{14}$ | 14,500 | 650 | 1,350 | 1,200 |
| Control 2 | Mn—Zn ferrite | 4,000 | 90 | 200 | 700 |

EXAMPLE 3

Amorphous alloys having a general formula "$(Fe_{0.55}Ni_{0.45})_{78}Si_{22-y}.B_y$" were produced as in Example 1 in an attempt to examine the effect of the boron content on the iron loss of the alloy. Specifically, the iron loss was measured under a magnetic flux density (Bm) of 3 kG and frequencies of 20 kHz and 50 kHz. FIG. 1 shows the results. It is seen that the iron loss under a high frequency region is small where the boron content falls within the range of between 5 and 9.5 atomic %, particularly, between 6 and 8 atomic %.

What we claim is:

1. An amorphous magnetic alloy low in iron loss having a general formula:

$$(Fe_{1-a}.Ni_a)_{100-x-y}.Si_x.B_y$$

where.

$0.2 \leqq a \leqq 0.7$ $1 \leqq x \leqq 20$ $5 \leqq y \leqq 9.5$ $15 \leqq x+y \leqq 29.5$ 2. The amorphous magnetic alloy according to claim 1, wherein the boron content meets the condition of: $6 \leqq y \leqq 8$.

3. The amorphous magnetic alloy according to claim 1, wherein the nickel content meets the condition of: $0.3 \leqq a \leqq 0.45$.

4. The amorphous magnetic alloy according to claim 1, wherein Fe is partly replaced by at least one element selected from the group consisting of Ti, V, Cr, Mn, Co, Zr, Nb, Mo, Ta and W in an amount of 1 to 10 atomic % based on the sum of transition metals in the alloy.

* * * * *

UNITED STATES PATENT AND TRADEMARK OFFICE

CERTIFICATE OF CORRECTION

PATENT NO. : 4,385,932

DATED : May 31, 1983

INVENTOR(S) : AMORPHOUS MAGNETIC ALLOY

It is certified that error appears in the above-identified patent and that said Letters Patent is hereby corrected as shown below:

Claim 1, last line, change "$15 \leq x + y \leq 29.5$" to

-- $10.5 \leq x + y \leq 29.5$ --.

Signed and Sealed this

*Fourteenth* Day of *August 1984*

[SEAL]

*Attest:*

GERALD J. MOSSINGHOFF

*Attesting Officer*

*Commissioner of Patents and Trademarks*